US006067688A

United States Patent [19]

West

[11] Patent Number: 6,067,688

[45] Date of Patent: May 30, 2000

[54] SHOE CLEANING DEVICE

[76] Inventor: William E. West, 2979 Highway 43 South, Loretto, Tenn. 38469

[21] Appl. No.: 09/193,934

[22] Filed: Nov. 17, 1998

Related U.S. Application Data

[60] Provisional application No. 60/065,871, Nov. 17, 1997.

[51] Int. Cl.[7] ..... A47L 5/38

[52] U.S. Cl. ..... 15/311; 15/36

[58] Field of Search ..... 15/311, 36, 37

[56] References Cited

U.S. PATENT DOCUMENTS

| | | | |
|---|---|---|---|
| 1,359,193 | 11/1920 | Parker | 15/311 |
| 1,361,068 | 12/1920 | Karro | 15/311 |
| 2,533,781 | 12/1950 | Fallowfield | 15/36 |
| 2,565,894 | 8/1951 | Stotz | 15/311 |
| 2,860,366 | 11/1958 | Kemp | 15/311 |
| 2,895,159 | 7/1959 | Ostrow | 15/311 |
| 3,044,099 | 7/1962 | Scott et al. | 15/311 |
| 3,054,129 | 9/1962 | Dragoon | 15/311 |
| 3,115,653 | 12/1963 | Fresh et al. | 15/311 |
| 3,737,942 | 6/1973 | Casey | 15/311 X |

*Primary Examiner*—Chris K. Moore
*Attorney, Agent, or Firm*—Mark Clodfelter

[57] ABSTRACT

A shoe bottom or side cleaning device which is either portable or installed in a floor of an entrance to a dwelling or building, and is either manually or automatically operated. The device includes a plurality of side-by-side, elongated and rotated brushes, a funnel beneath the brushes, a motor for driving the brushes and a squirrel cage fan for collecting dirt from the brushes via the funnel, and a chamber for accumulating the collected dirt. The chamber can be equipped with a dirt collection bag. A central building vacuum system can assist the device's fan. The elongated brushes can have either a solid core or a twisted" wire core.

11 Claims, 3 Drawing Sheets

SHOE CLEANING DEVICE

This application claims benefit of provisional application 60/065,871 Nov. 17, 1997.

BACKGROUND OF THE INVENTION

1. Field of the Invention

The present invention, which I prefer to call the "Carpet Saver", relates to a shoe bottom cleaning device or apparatus which may be either portable or installed in a floor of an entrance to a dwelling or building for the protection of carpeting, and may be either manually or automatically operated. The apparatus has an internal fan for a vacuum source or may be connected to a building vacuum source.

2. Description of Related Art

Homes apartment buildings and commercial buildings have expensive carpeting which requires expensive cleaning and replacement due to dirt and mud tracked into the building by persons with dirty and muddy shoes. The present invention offers a versatile and compact shoe bottom cleaning apparatus for owners of dwellings or buildings.

Although the related art describes various shoe cleaning devices, there is a failure to show a versatile and economical apparatus which can be made either portable or installable in the floor of an entrance inside a dwelling or a commercial building.

Related art of interest will be discussed in the order of their perceived relevance to the present invention.

U.S. Pat. No. 2,533,781 issued on Dec. 12, 1950, to Thomas Fallowfield, Jr. describes a self cleaning door mat which is installed in the floor of buildings inside the entrance. A rectangular housing has two compartments to house in the larger compartment a rotating brush on an endless belt supported by large end rollers, and a plurality of intermediate smaller rollers seated on three longitudinal bed rails on top of three transverse frame members. The dirt is brushed off by a rotating brush under suction at one end into a pipe which leads into the smaller compartment containing the suction fan driven by an electric motor. The suction fan forces the dirt into an upper part of a removable closed tank at an opposite end to the motor. The tank can be, alternatively, an electrical dust precipitator of conventional construction. No air exhaust means is disclosed. The rotating brushes can be aligned either transversely or longitudinally. The patent neither teaches nor suggests that a plurality of axially oriented brushes exposed in individual slots can be individually rotated.

U.S. Pat. No. 2,895,159 issued on Jul. 21, 1959, to Henry J. Ostrow describes an automatic electric brushing mat comprising a plurality of reciprocating (not rotating) elongated brushes in individual chambers and reciprocated back and forth by a crankshaft. The crankshaft is driven by an electric motor in a separate vertical cylindrical compartment having an end pulley for driving the crankshaft and an exhaust blower for creating a vacuum pull for the dirt. The dirty air passes through a dirt collector bag above the motor in a removable compartment to be exhausted through a nozzle. A pressure sensitive switch located underneath the mat actuates the brushes. The patent is distinguished by the non-rotating brushes and the obtrusive projecting housing for the motor and dirt collection bag.

U.S. Pat. No. 2,565 issued on Aug. 28, 1951, to Ottmar Stotz describes a boxed shoe cleaning apparatus containing an endless brush for cleaning a shoe at a time. The brush is rotated on four rollers, wherein the proximate roller is driven by an electric motor in a separate compartment by a belt. The motor drives a suction fan which draws air from the brush compartment and exhausts the dirty air into a dirt container. Another collection region for heavy dirt is located underneath the brush, and the dirt is removed by access from a removable plate. The patent is distinguished by its single belted brush.

U.S. Pat. No. 4,014,060 issued on Mar. 29, 1977, to Wallace N. Taylor describes a shoe sole cleaner apparatus recessed below a floor or walk having transverse grill elements, and equipped with protruding bristles of a rotatable endless belt on rollers. The brush is energized by a foot pressure active control switch.

U.S. Pat. No. 2,463,153 issued on Mar. 1, 1949, to Elbert F. Conklin describes a portable boxed shoe cleaning machine with a rotating endless bristled belt brush contacting an elevated rotary brush for cleaning the instep shoe portion as well as other surfaces of a shoe. The mechanism involves an externally housed motor to provide space for an exhaust fan with elongated, transversely arcuate blades. End rollers drive the belted brush and the elevated brush over intermediate rollers with pulleys driven by two belts. A dust collecting drawer is provided, but no exhaust port is described. This patent is distinguished by its essential different brush configurations and lack of description regarding whether the device is manually or automatically operated.

U.S. Pat. No. 3,084,361 issued on Apr. 9, 1963, to Leoland T. Outlaw describes an automated electric shoe sole cleaner apparatus with an elongated treadle seat actuating the raising of an elongated rotating brush through a grill. The apparatus is set in a recess in pavement. This patent is distinguished by its lack of a vacuum and a collection chamber.

U.S. Pat. No. 4,118,818 issued on Oct. 10, 1978, to Eileen M. Holleran describes an apparatus for cleaning the lower portion of shoes by an arrangement of toe and heel brushes placed perpendicularly to and above four parallel brushes inside a frame. The brushes are cleaned by combs. The dirt is pulled by a vacuum developed by a vacuum turbine and a clutched motor through ducts (not shown) to the collection tray. Two sets of bevelled gears and a train of spur gears are shown without the use of any belts. This patent is distinguished by its non-planar brush configuration situated inside a box and a light sensor (and manual shut off system) for automating the system.

U.S. Pat. No. 4,724,564 issued on Feb. 16, 1988, to Elwyn N. Fresh describes a rectangular household shoe cleaning apparatus with a grasping handle or rail and a cowling. The shoe rests on a transverse bar for cleaning the instep by a vertically positioned oscillating brush or by a fixed elongated brush located at the rear, cleaning the sole by a transverse rotary brush, and the heel by a longitudinally positioned reciprocating brush. The oscillating brush is driven by the transverse rotary brush through mechanical connections. The rotary brush is belt driven and the reciprocating brush is cam driven by a motor with a squirrel cage fan. The dirt is collected on a side with a slot for an external filter bag. A manual switch is located on top of the frame. This patent is distinguished by its manifold system of brushes and associated machinery coupled with the handle bar and cowling.

U.S. Pat. No. 4,922,578 issued on May 8, 1990, to Veli V. Miettinen describes a photocell actuated shoe sole cleaner apparatus consisting of a floor mat containing a plurality of brush rods vibrated by a hydraulically pressured cam and springs driven by a wall mounted hydraulic power unit. This patent is distinguished by its hydraulic power and the lack of vacuum suction and dirt collection structure.

The disclosures of the related art are hereby incorporated by reference herein. None of the above inventions and patents taken either singly or in combination, are believed to describe the instant invention as claimed.

SUMMARY OF THE INVENTION

The present invention is directed to a shoe cleaning device or apparatus operated by electrical power, with a three-way switch to permit the versatility of on, off, and automatic operation. The apparatus is also versatile in its location as having the capability to be placed in the floor inside an entrance, or placed strategically near the entrance on the floor for a person to clean off a bottom and adjacent sides of his or her shoes. Dirt and mud are scraped from shoes of a user by a series of long brushes exposed in vents provided in a top cover of the cleaning device. A motor drives an intake fan which draws in the removed dirt and mud particles. Pairs of adjacent brushes are rotated in opposite axial directions to more effectively accomplish the cleaning action. The motor drives a pulley and gear system in addition to the suction fan causing the removed dirt to pass to a collection chamber, which may be provided with a collection bag. The clean air is exhausted from a side aperture in the dirt collection chamber. Access to the fan, motor, collection chamber and the bag (if provided) is available by hinging the top cover and frustoconical element, allowing the top cover and frustoconical element to be pivoted upward. Alternatively, the vacuum source may be augmented by attachment to a central building vacuum source typically used for vacuuming floors and the like.

Accordingly, it is a principal object of the invention to provide a shoe bottom cleaning apparatus installable inside an entrance to a building.

It is another object of the invention to provide a shoe bottom cleaning apparatus adapted for being portable or installable in a floor.

It is a further object of the invention to provide a shoe bottom cleaning apparatus which can be operated either automatically or manually.

Still another object of the invention is to provide a shoe bottom cleaning apparatus which can be readily cleaned as needed.

Yet another object of the invention is to provide a shoe bottom cleaning apparatus which may have its vacuum source augmented by connection to a central building vacuum system.

It is a broad object of the invention to provide improved elements and arrangements thereof in an apparatus for the purposes described, which is inexpensive, dependable and fully effective in accomplishing its intended purposes. These and other objects of the present invention will become readily apparent upon further review of the following specification and drawings.

BRIEF DESCRIPTION OF THE DRAWINGS

Like reference numerals are intended to refer to like elements throughout the various views.

DETAILED DESCRIPTION OF THE PREFERRED EMBODIMENTS

Figure 1:
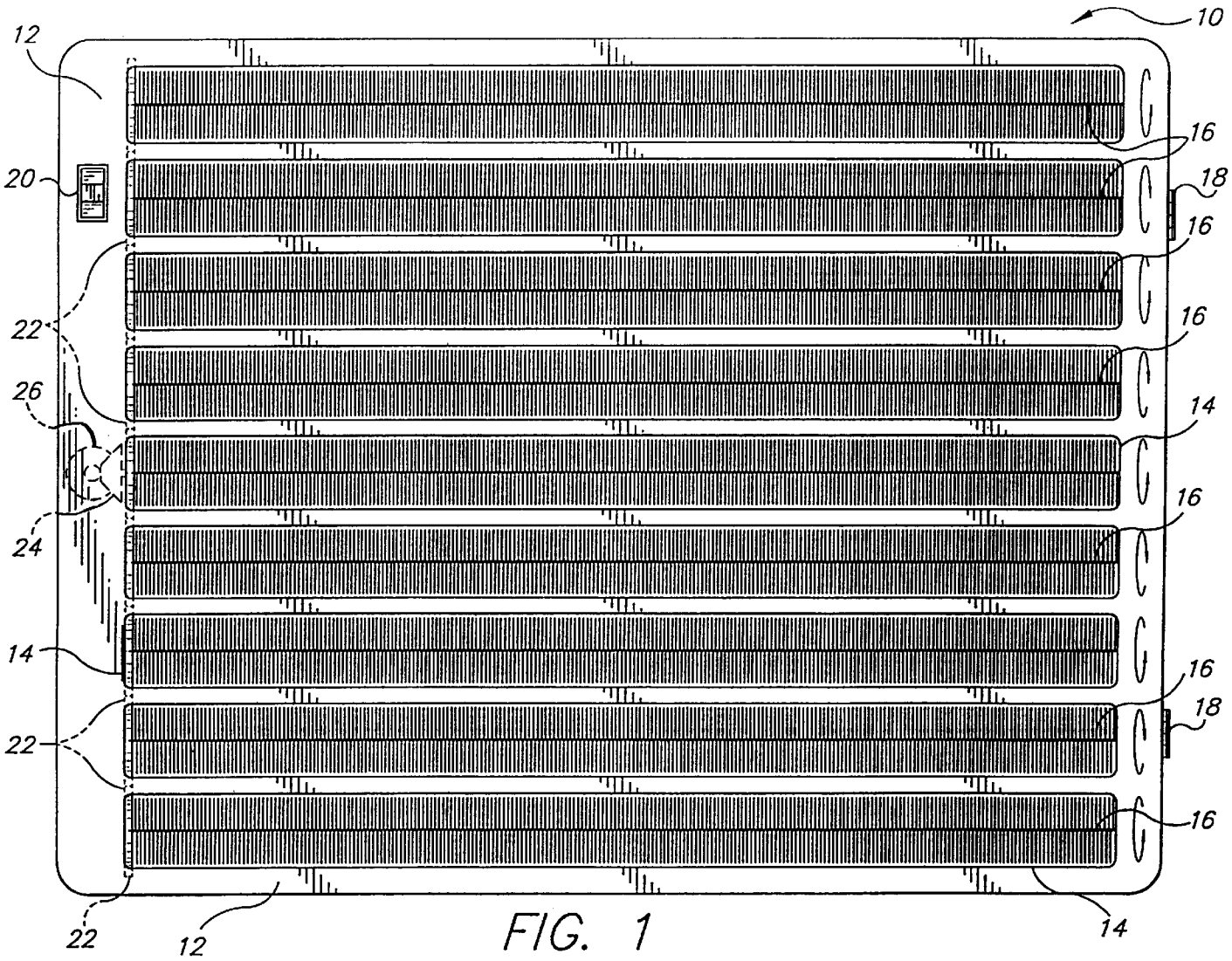
FIG. 1 is top view of a shoe bottom cleaning apparatus with gearing (dash lines) and directional arrows indicating rotation of the brushes.

The present invention is directed to a shoe bottom and side cleaning apparatus or device which may be portable or installed in a floor of an entrance to a dwelling or building and can be manually or automatically operated. Here, the apparatus 10 may be constructed so that it is portable, and placed adjacent the entrance to a building with the necessary to wiring to an electrical outlet FIG. 1 is a top plan view of the shoe bottom and side cleaning apparatus 10, which is either portable or permanently placed in the flooring of an entrance inside or outside the building. A durable metal cover 12 having nine elongated and parallel slots 14 for the exposure of elongated brushes 16 rotating in the directions indicated by the directional arrows at the right side of the view. In one embodiment, the bristles are made of plastic and arranged in helical fashion on a twisted metal core containing an axle. Alternately, metal bristles may be used, these metal bristles mounted on any form of axle suitable for this application. Both ends of the axles of each of the brushes 16 may be journaled into cover 12, and rotatably supported by antifriction bushings or bearings. In another embodiment, ends of the brushes may be journaled into bushing or bearing blocks (not shown) set in outer casing 28 in a manner similar to brushes found in upright vacuum cleaners so that the brushes may be easily removable. It is to be emphasized that cover 12 and device 10 are of heavy-duty construction so as to support weight of an individual standing on cover 12. While nine brushes and their respective slots are shown in this embodiment, any number of brushes sufficient for cleaning soles of a shoe and closely adjacent shoe surfaces may be used. Here, where it is contemplated that both shoes be cleaned simultaneously, nine or so brushes may be employed. Likewise, a larger model may be built for an entryway of a retail store or the like where shoes of several people may be cleaned at once. In a smaller device, where shoes are cleaned one at a time, as few as three or so brushes may be used. Where desired, a clutching device (not shown) may be used in the drive train to allow slippage in the instance the brushes become blocked.

The cover 12 has two hinges 18 and a three-way switch and weight sensor device 20 (shown in the upper left corner of the view) for on, off and automatic operation of cleaning apparatus 10. The drawing further illustrates relative positions of spur gears 22 in a train (shown at left in dashed lines) driving the brushes 16. Here, the end gear 22 of the central brush 16 is additionally configured having a bevel gear 24 which cooperates with a second, powered bevel gear 26. With this construction, when cover 12 is pivoted upward as described, brushes 16 are also pivoted upward along with cover 12. When cover 12 is lowered, bevel gear 24 automatically meshes with powered bevel gear 26.

Figure 2:
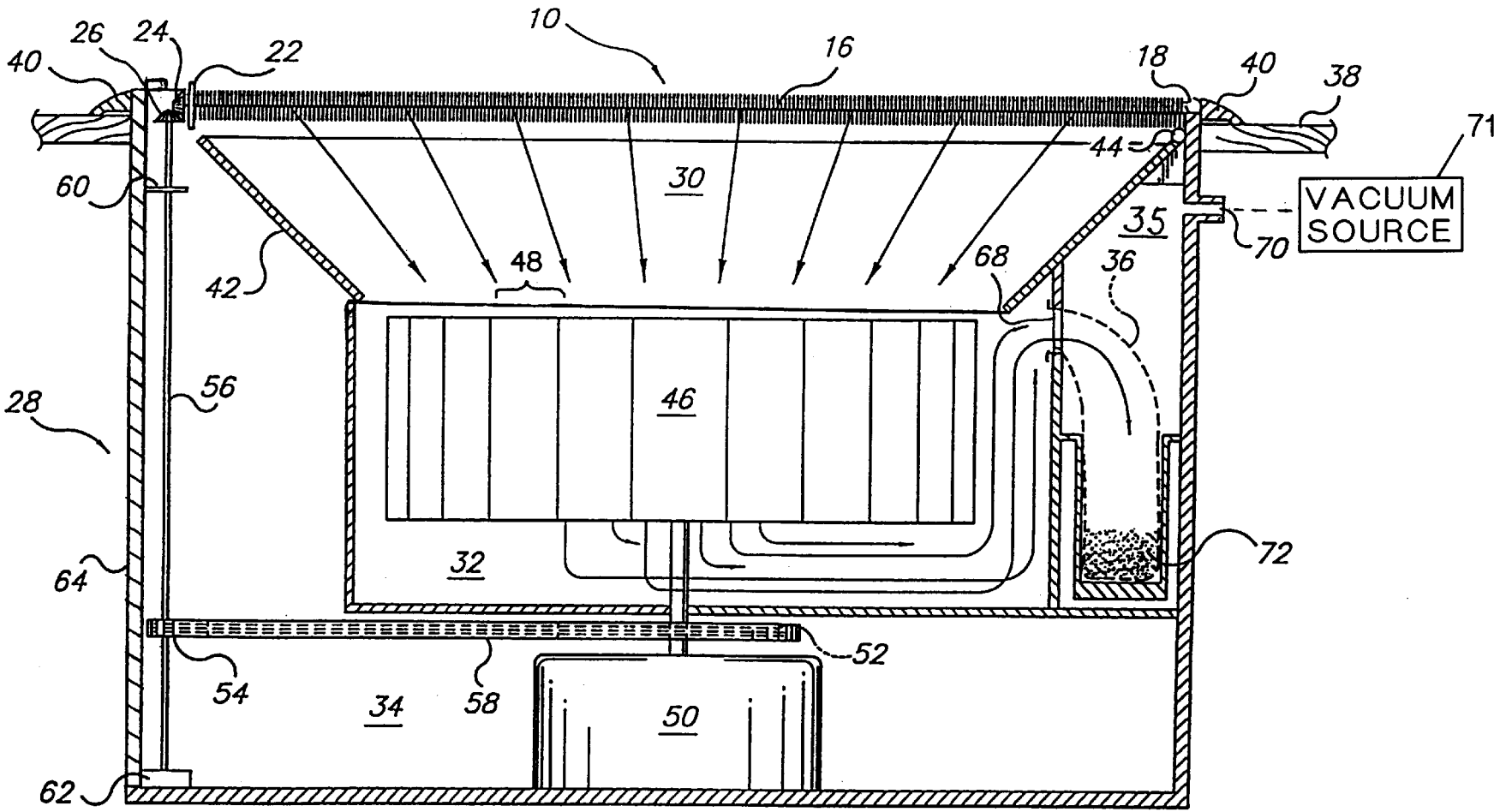
FIG. 2 is a schematic side sectional view of the shoe bottom cleaning apparatus installed in a floor.

Turning to FIG. 2, which is an example of the floor installed embodiment of the shoe cleaning device shown without cover 12, outer casing 28 is shown with a suction chamber 30, a fan chamber 32, a motor and brush driving means 34, and a dirt collection chamber 35. Directional arrows show the direction of travel of air and dirt drawn in through apparatus 10 from slots 14 (FIG. 1) and into a filter bag 36. While bristles of brushes 16 are shown as being relatively short, it is contemplated that the bristles of brushes 16 extend upward through slots 14 and cover 12 (FIG. 1) by as much as 1.5 inches.

For a permanent installation, apparatus 10 may be set in a floor 38 in the position shown, with escutcheon molding 40 bordering the outer casing 28 to permit a slight elevation of apparatus 10 above a level of floor 38. Alternately, apparatus 10 may be mounted so that cover 12 is elevated above floor 38 only to the extent necessary to allow pressure sensitive switch 22 to operate.

The suction chamber 30 comprises an inverted frustum-shaped element or funnel-shaped plenum 42 which is hinged at one end by a hinge 44 to permit access to fan 46 for cleaning and disposal of filter bag 36. The funnel 42 can be rectangularly configured at a region near brushes 16 and circular at a region adjacent fan 46. Where the suction chamber 30 is configured as a circular framed compartment, the funnel 42 and cover 12 may be circular. Constructed as described, dirt from shoes of a user is drawn in through slots 14 (FIG. 1) and driven by fan 46 into a filter bag 36 positioned in dirt collection chamber 35.

Fan chamber 32 comprises a suction or squirrel cage fan 46 with inclined vanes 48 to direct the incoming air and entrapped dirt down and into the dirt collection chamber 35 and the filter bag 36. It is within the ambit of the present invention to utilize an available central building vacuum source to augment the vacuum required for suction.

The motor and brush driving chamber 34 includes an electric motor 50 which drives the fan 46 and a first drive pulley 52. A second pulley 54 on a vertical shaft 56 is driven by an endless belt 58 around the pulleys 52, 54. Shaft 56 is held in position by an upper holder bracket 60 provided with an antifriction bushing or bearing and a base holder 62 also provided with an antifriction bushing or bearing. While a drive belt and pulleys are disclosed, other rotary drive means may also be employed, such as sprockets and a chain, or a gearing arrangement. The first bevelled gear 26 located at the terminal end of the shaft 56 meshes with a second bevelled gear 24 located as described at the end of the center brush 16 which also supports a spur gear 22. These elements provide the drive train for rotating the elongated brushes 16 in counter rotating directions as illustrated in FIG. 1. It is believed such counter rotating brushes achieve a superior cleaning action because the counter rotating brushes scrub two adjacent surfaces simultaneously. For servicing, the chamber 34 may be accessed by a removable side panel 64 proximate shaft 56.

The chamber 34 also contains a weight sensor/three-way switch device 20 adjacent the cover 12 which permits "on", "off" and automatic control of the apparatus 10. The automatic control consists of a pressure sensor which, upon foot pressure on the cover 12, actuates the motor 50 automatically until the pressure is removed. It should be understood that the electrical wiring required for operating the motor 50 and the switch 20 are known in the art and need not be shown.

The diagrammatic illustration of dirt collection chamber 35 containing the filter bag 36 and dirt 72 may be provided with a removable container, basket or other support for dirt filter bag 36, with the opening of filter bag 36 being attached to an entry port or vent aperture 68. The container or basket supporting bag 36 is of a sieve-like construction in order to permit free passage of air through bag 36. Also, aperture 68 and chamber 35 may be configured to receive any of a number of commercially available filter bags designed for use with a conventional vacuum cleaner. The filtered air is exhausted through an exit port 70. Significantly, port 70 may be coupled to an external vacuum system 71, which may be a centralized vacuum system in a building or a conventional portable vacuum cleaner in order to augment the action of fan 46. In an alternate embodiment, fan 46 and chamber 32 may be omitted, with vacuum from source 71 providing a vacuum to draw a dirt into bag 36. Here, dirt may be allowed to accumulate in a lower region of plenum 30 and periodically removed by connection to a vacuum cleaner of either of the two described types. Where device 10 is constructed for exclusive outdoor use, filter bag 36 and compartment 35 may be omitted, with dirt removed from shoes of a user simply being vented into a yard or other such area. In this embodiment, a relatively large diameter hose may be coupled to a side of enclosure 28 containing filter bag 36 to direct dirt away from an entryway, or this side may simply have an opening therein so that dirt is blown from device 10 away from the entryway.

Figure 3:
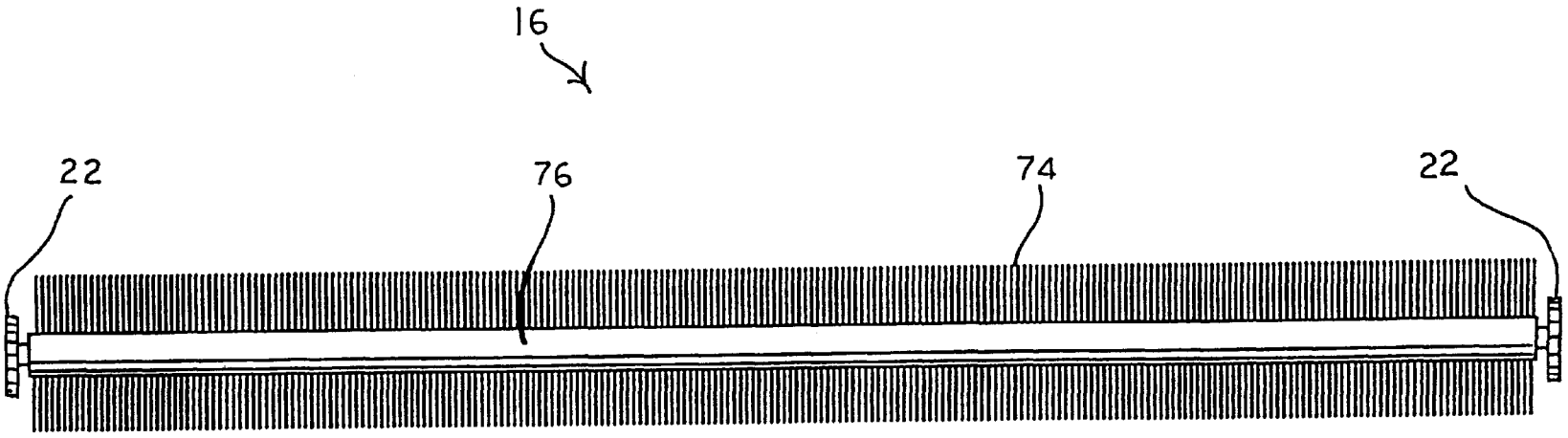
FIG. 3 is a side elevational view of one embodiment of a brush.

FIG. 3 depicts one embodiment of brush 16 having a cylindrical brush core 76 which may be of a plastic molded material supporting stiff plastic bristles 74. A solid core 76 provides stability of the brush 16 along its length under the pressure of a shoe. However, it is also contemplated that a twisted metal wire core as shown in FIGS. 1 and 2 with entwined plastic bristles may also be utilized. While these types of brushes are disclosed,. the present invention is not limited to a certain number of brushes or the arrangement thereof. Additionally, other brushes placed at right angles to the linear arrangement shown can be included by appropriate gearing modifications in view of the Holleran U.S. Pat. No. 4,118,818.

In view of the foregoing, the present invention provides an economical and versatile apparatus for cleaning the bottom and sides of any dirty shoe before entering or shortly entering a building to maximize the life of expensive carpeting and minimize any cleaning of carpeted or uncovered floors. Such cleaning is accomplished by standing on cover 12 to energize the device (or operating a switch to energize the device manually) while working the shoes over the rotating brushes to remove dirt and mud therefrom. As stated, the removed dirt and mud is deposited in a filter bag or otherwise stored, removed or exhausted from the device.

Having thus described by invention and the manner of its use, it is to be appreciated that incidental changes may be made to the present invention that fairly fall within the scope of the following appended claims, wherein I claim:

What is claimed is:

1. A shoe cleaning device comprising:

a casing including a top cover having a plurality of slots;

a plurality of elongated brushes rotatably mounted in said casing, a funnel-shaped plenum within said casing situated proximate to said cover;

a suction fan;

an electric motor having a first shaft connected to said fan and having a first drive pulley;

a second shaft having a second pulley mounted thereto proximate its lower end and a first bevelled gear at an opposite end;

a drive belt between said first and second pulleys for transferring power from said drive pulley to said second pulley a second bevelled gear in meshing engagement with said first bevelled gear, said second bevelled gear connected to said brushes;

a spur gear on one of each of said plurality of elongated brushes at one end thereof, each said spur gear in meshing engagement with at least one of said spur gears on adjacent said brushes, a switching device for switching said motor on and off;

a dirt collection compartment comprising:

an entry port communicating with said plenum, a filter bag having an interior communicating with said entry port, and an exit port for exhausting air drawn through said shoe cleaning device, whereby said fan draws air through said plurality of parallel slots while said plurality of elongated brushes are rotated by said second shaft being driven by said first drive pulley, said second pulley and said first and second bevelled gears, drawing dirt brushed from shoes through said entry port and into said filter bag in said dust collection compartment and exhausting generally cleaned air through said exit port.

2. The device according to claim 1 including hinges for said cover and hinges for said funnel, and a removable side access panel in said casing for cleaning of said shoe cleaning device.

3. The device according to claim 1, said device being constructed as a self-contained, portable unit.

4. The device according to claim 1, said device being constructed as a fixed unit and being permanently located in a floor adjacent to an entrance of a building.

5. The device according to claim 1, said device being connected to an external vacuum system for augmenting the suction of said device's suction fan.

6. The device according to claim 1 wherein said external vacuum system is a centralized vacuum system of a building.

7. The device according to claim 1 wherein said external vacuum system is a conventional vacuum cleaner.

8. The device according to claim 1, each of said plurality of elongated brushes comprising bristles being molded into a cylindrical core.

9. The device according to claim 1, each of said plurality of elongated brushes comprising bristles being entwined in a twisted wire.

10. The device according to claim 1 wherein said switching device, in addition to allowing manual on-off operation of said motor, is constructed to automatically switch said motor to an energized state responsive to weight being applied to said top cover and to a deenergized state when said weight is removed from said top cover.

11. The device according to claim 1 wherein said filter bag is a conventional vacuum cleaner bag.

* * * * *